US006997287B2

(12) United States Patent
Sasaki

(10) Patent No.: US 6,997,287 B2
(45) Date of Patent: Feb. 14, 2006

(54) ELEVATOR EMERGENCY STOPPING DEVICE

(75) Inventor: Hirotada Sasaki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 14 days.

(21) Appl. No.: 09/890,407

(22) PCT Filed: Jan. 10, 2001

(86) PCT No.: PCT/JP01/00059

§ 371 (c)(1),
(2), (4) Date: Nov. 5, 2001

(87) PCT Pub. No.: WO01/51399

PCT Pub. Date: Jul. 19, 2001

(65) Prior Publication Data

US 2002/0134624 A1 Sep. 26, 2002

(30) Foreign Application Priority Data

Jan. 11, 2000 (JP) ..... 2000-002793

(51) Int. Cl.
*B66B 5/22* (2006.01)

(52) U.S. Cl. ..... 187/376; 187/372; 188/343; 188/189

(58) Field of Classification Search ..... 187/350, 187/351, 372, 376; 188/343, 188, 189
See application file for complete search history.

(56) References Cited

U.S. PATENT DOCUMENTS

| | | | | | |
|---|---|---|---|---|---|
| 2,555,041 | A | * | 5/1951 | King | 187/372 |
| 4,819,765 | A | | 4/1989 | Winkler et al. | |
| 5,096,020 | A | | 3/1992 | Korhonen | |
| 5,159,995 | A | * | 11/1992 | Sissala et al. | 187/376 |
| 5,197,571 | A | * | 3/1993 | Burrell et al. | 187/350 |
| 5,363,942 | A | | 11/1994 | Osada | |
| 5,370,208 | A | * | 12/1994 | De Jong | 187/372 |

FOREIGN PATENT DOCUMENTS

| | | | | | |
|---|---|---|---|---|---|
| DE | 195584 | A | * | 2/1908 | 187/376 |
| DE | 433217 | A | * | 8/1926 | 187/376 |
| DE | 498917 | A | * | 5/1930 | 187/372 |
| EP | 957059 | A2 | * | 11/1999 | |
| JP | 62-295886 | | | 12/1987 | |
| JP | 3-211181 | | | 9/1991 | |
| JP | 6-255949 | | | 9/1994 | |
| JP | 7-17676 | | | 1/1995 | |
| JP | 2000-302351 | | | 10/2000 | |
| JP | 2001-2342 | | | 1/2001 | |
| SU | 659503 | A | * | 4/1979 | 187/372 |
| SU | 1039848 | A | * | 9/1983 | 187/376 |
| SU | 1121225 | A | * | 10/1984 | 187/372 |

* cited by examiner

*Primary Examiner*—Eileen D. Lillis
*Assistant Examiner*—Thuy V. Tran
(74) *Attorney, Agent, or Firm*—Finnegan, Henderson, Farabow, Garrett & Dunner, L.L.P.

(57) ABSTRACT

In an elevator emergency stop device wherein emergency stop of the elevator cage (20) is achieved by generating frictional force at a sliding part (11) and guide rail (1) by pressing a sliding part (11) against guide rail 1 using a wedge-shaped element (3), in wedge-shaped element (3), the dimension in the direction perpendicular with respect to the sliding faces on the guide rail (1) and sliding part (11) is changed in accordance with the braking force.

An elevator emergency stop device can thereby be provided wherein the braking force is kept constant even though the coefficient of friction changes.

8 Claims, 10 Drawing Sheets

ELEVATOR EMERGENCY STOPPING DEVICE

TECHNICAL FIELD

The invention relates to an elevator emergency stop device for effecting emergency stop of the cage when the speed of ascent or descent of the cage exceeds the legally specified speed, and more particularly relates to an elevator emergency stop device that is ideal for application to high speed elevators capable of exceeding 10 m/s.

TECHNICAL BACKGROUND

According to Article No. 129 No. 7 of the Order putting into effect the Building Standards Law of Japan, elevators are required to have installed a safety device which automatically restrains descent of the cage if the speed of the descending cage exceeds a prescribed value. A speed regulator 14 (what is sometimes called a governor) that detects the speed of cage 20 is therefore installed in the machinery room at the top of the ascent/descent path as shown in FIG. 11.

In speed regulator 14, speed regulator 14 is arranged to be rotated with ascent/descent of the cage by a means of a speed regulator rope 15 that is wound thereon with a middle part thereof connected to a safety link 17 of cage 20. The lower part of speed regulator rope 15 is wound onto a speed regulator rope tensioning pulley 16 that applies a suitable tension to speed regulator rope 15.

If a pre-set speed of speed regulator 14 is exceeded, a rope-gripping unit 19 incorporated in speed regulator 14 is actuated to grip speed regulator rope 15. Safety link 17 is thereby actuated, arresting the descent of pulling-up rods 2 of descending cage 20. That is, seen from the side of cage 20, pulling-up rods 2 ascend, causing a wedge-shaped element 3 that is linked to the bottom end of pulling-up rods 2 and is shown in detail in FIG. 12 and FIG. 13 to be also pulled up, with the result that frictional force is generated between wedge-shaped element 3 and guide rail 1, thereby effecting emergency stop of cage 20.

FIG. 12 is a front view illustrating an example of a prior art elevator emergency stop device and FIG. 13 is a cross-sectional view along B-B of FIG. 12. In FIG. 12 and FIG. 13, the upper surface of this elevator emergency stop device 18 is fixed to the bottom beam of cage 20. Also, in plan view, not shown, the framework of this elevator emergency stop device 18 is constituted by a pair of pillars, not shown, made of angle steel, welded above and below to an approximately square-shaped top plate 9A and a bottom plate 9B that is of approximately the same shape as this top plate 9A and slightly smaller than in thickness. As shown in FIG. 13, a U-shaped groove 9*a* into which the head of a guide rail 1 shown by the chain line fits freely is formed in the front middle part of top plate 9A and bottom plate 9B.

As shown in FIG. 12, a step 9*d* is formed on the under-surface at the front end on both sides of top plate 9A, and a land-shaped guide seat 9*b* is formed on the upper surface at the front end on both sides of bottom plate 9B. Horizontal steps 9*c* are formed symmetrically with steps 9*d* of top plate 9A described above on the outside upper surface of this guide seat 9*b*.

A pair of guide plates 6 are provided on these steps 9*c* and 9*d*. Specifically, a pair of guide plates 6 are formed approximately in channel-section shape, with abutments 6*a* and 6*b* projecting on opposite sides at their top and bottom ends. Thus, abutments 6*a* and 6*b* of guide plates 6 are inserted from outside onto steps 9*c* and 9*d* and the opposite faces of guide plates 6 are inclined such that their separation becomes wider in the downwards direction.

Channel-section grooves 6*c* are formed on the outside of the left and right guide plates 6; as shown in FIG. 12, the two ends of a plate spring 7 made of thick sheet formed in a U-shape are freely fitted into these grooves.

A pair of pressure seats 8 are inserted beforehand from the inside at both ends of this plate spring 7. The major parts of the hemispherical portions of the heads of these pressure seats 8 are fitted into hemispherical recesses formed at the top and bottom of grooves 6*c* of guide plate 6, so that by pressing these hemispherical portions into the recesses by means of the restoring force of plate spring 7 the attitude of plate spring 7 is thereby maintained.

Reference numeral 2 indicates the pulling-up rods referred to above, which are made of strip-shaped steel. The bottom ends of practically trapezoid-shaped wedge elements 3 are linked through pins with the bottom ends of these pulling-up rods 2. As shown in FIG. 12, guide grooves parallel with the outside inclined faces are formed on the outer face sides of the front and rear faces of these wedge-shaped elements 3. Likewise, guide grooves shown in FIG. 12 are formed also on the front and rear faces on the opposite side of each of the guide plates 6 mentioned above.

Bent sections on both sides of a holding plate 4A formed approximately in the shape of a gutter as shown in FIG. 13 are fitted into guide grooves formed in these guide plates 6 and guide grooves formed in wedge-shaped element 3 referred to above. Shaft sections projecting at both ends of rollers SA are inserted into shaft holes at an number of locations formed on the center line of front and rear holding plates 4A.

Holding plates 4A are therefore free to move upwards together with rollers 5A by means of the bent sections thereof whereof one side is fitted into the groove formed in a guide plate 6. An identical elevator emergency stop device 18 is also provided on the other side and may further be mounted on the counter-weight.

With an elevator emergency stop device 18 constructed in this way, when the speed of descent of the cage 20 shown in FIG. 11 or counter-weight, not shown, exceeds a specified value, speed regulator rope 15 is gripped by rope gripping unit 19 of speed regulator (governor) 14. Pulling-up rods 2 are therefore arrested in advance of cage 20, causing these to be raised relative to cage 20 and guide plates 6. The wedge-shaped elements 3 that abut the bottom ends of these pulling-up rods 2 are thereby raised with respect to the cage 20 or counter-weight. When this happens, the opposite faces of the pair of wedge-shaped elements 3 are pressed against the side faces of the head of guide rail 1, causing the guide rail 1 to be gripped from both sides, thereby arresting cage 20 or the counter-weight.

The rollers 5 that are inserted in holding plates 4A that ascend together with the wedge-shaped elements 3 are incorporated in order to prevent lowering of the pressing force onto the guide rail 1, by reducing the friction between the wedge-shaped elements 3 and guide plates 6, thereby ensuring that the action of raising the wedge-shaped elements 3 takes place smoothly.

Although in general the coefficient of dynamic friction takes a fixed value determined by the material properties of the sliding members and/or the condition of the sliding surfaces etc., irrespective of the sliding velocity, in the region where the sliding velocity exceeds 10 m/s, it has been experimentally confirmed that the coefficient of dynamic friction decreases with increase in velocity.

However, with the conventional elevator emergency stop device, sliding takes place between the wedge-shaped elements and the guide rail with a pair of wedge-shaped elements being pressed on to the guide rail with a pre-set spring force i.e. always with a fixed pressing force.

Consequently, changes in the coefficient of dynamic friction are directly reflected in changes in the breaking force and in the case of a high-speed elevator capable of exceeding 10 m/s, as shown in FIG. 3A, in emergency braking using such an elevator emergency stop device, the elevator speed is high in the initial period of braking and the coefficient of friction is small. The degree of deceleration is therefore small but immediately before stopping the speed becomes slower and the frictional force becomes large, so the degree of deceleration becomes large.

In the Order implementing the Building Standards Law referred to above, a mean deceleration under emergency braking of 0.35 G to 1.0 G is laid down, so in the case of emergency braking at a speed of above 15 m/s, the deceleration immediately before stopping becomes extremely large, resulting in considerable load on the passengers.

DISCLOSURE OF THE INVENTION

An object of the invention is to provide an elevator emergency stop device wherein the passenger cage can be stopped safely while maintaining a fixed deceleration during emergency braking of a high-speed elevator.

In order to achieve the above object, in an elevator emergency stop device according to an embodiment of the invention the wedge-shaped element comprises a mechanism whereby its dimension in the direction perpendicular with respect to the sliding faces on the guide rail and sliding member is changed in accordance with braking force.

In this way, the braking force of the elevator emergency stop device can be kept constant by adjusting the force with which the wedge-shaped element presses against the guide rail.

An elevator emergency stop device according to an embodiment of the invention comprises: a fixed part having an outside inclined face part of the wedge-shaped element; and a wedge-shaped moveable part having the sliding member; this moveable part being moveable along the inside inclined face part of the fixed part and the upper part thereof being engaged with the fixed part by means of a resilient element.

In this way, the braking force of the elevator emergency stop device can be kept constant by adjusting the width of the wedge-shaped element as a whole by the moveable part moving along the inside inclined face of the fixed part in accordance with the braking force of the elevator emergency stop device.

An elevator emergency stop device according to an embodiment of the invention comprises a fixed part having an outside inclined face part of the wedge-shaped element and a wedge-shaped moveable part having a sliding member, this moveable part being capable of moving along the inside inclined face of the fixed part and its upper part being engaged with the fixed part by means of a pair of sliding elements sandwiching a resilient element.

In this way, the moveable part moves smoothly over the inside inclined face of the fixed part in accordance with the braking force of the elevator emergency stop device, thereby achieving finer adjustment of the width of the wedge-shaped element as a whole, and so making it possible to keep the braking force of the elevator emergency stop device fixed.

An elevator emergency stop device according to an embodiment of the invention comprises a fixed part having an outside inclined face part of the wedge-shaped element and a wedge-shaped moveable part having a sliding member, this moveable part being capable of movement along the inside inclined face of the fixed part and the upper part thereof being engaged with the fixed part by means of a resilient element whereof the relationship of load and flexure changes in two steps.

In this way, the moveable part moves over the inside inclined face of the fixed part in response to the excessive braking force of the elevator emergency stop device, thereby achieving finer adjustment of the width of the wedge-shaped element as a whole, and so enabling the braking force of the elevator emergency stop device to be kept fixed.

An elevator emergency stop device according to an embodiment of the invention comprises a fixed part having an outside inclined face part of the wedge-shaped element and a wedge-shaped moveable part having a sliding member, this moveable part being capable of movement along the inside inclined face of the fixed part and the upper part thereof being connected with the fixed part by means of a piston which is given an initial pressure.

In this way, the moveable part moves over the inside inclined face of the fixed part only in response to the excessive braking force of the elevator emergency stop device, thereby achieving finer adjustment of the width of the wedge-shaped element as a whole, and so enabling the braking force of the elevator emergency stop device to be kept fixed.

BEST MODE FOR IMPLEMENT THE INVENTION INTO EFFECT

An embodiment of an elevator emergency stop device according to the invention is described below with reference to the drawings.

Figure 1:
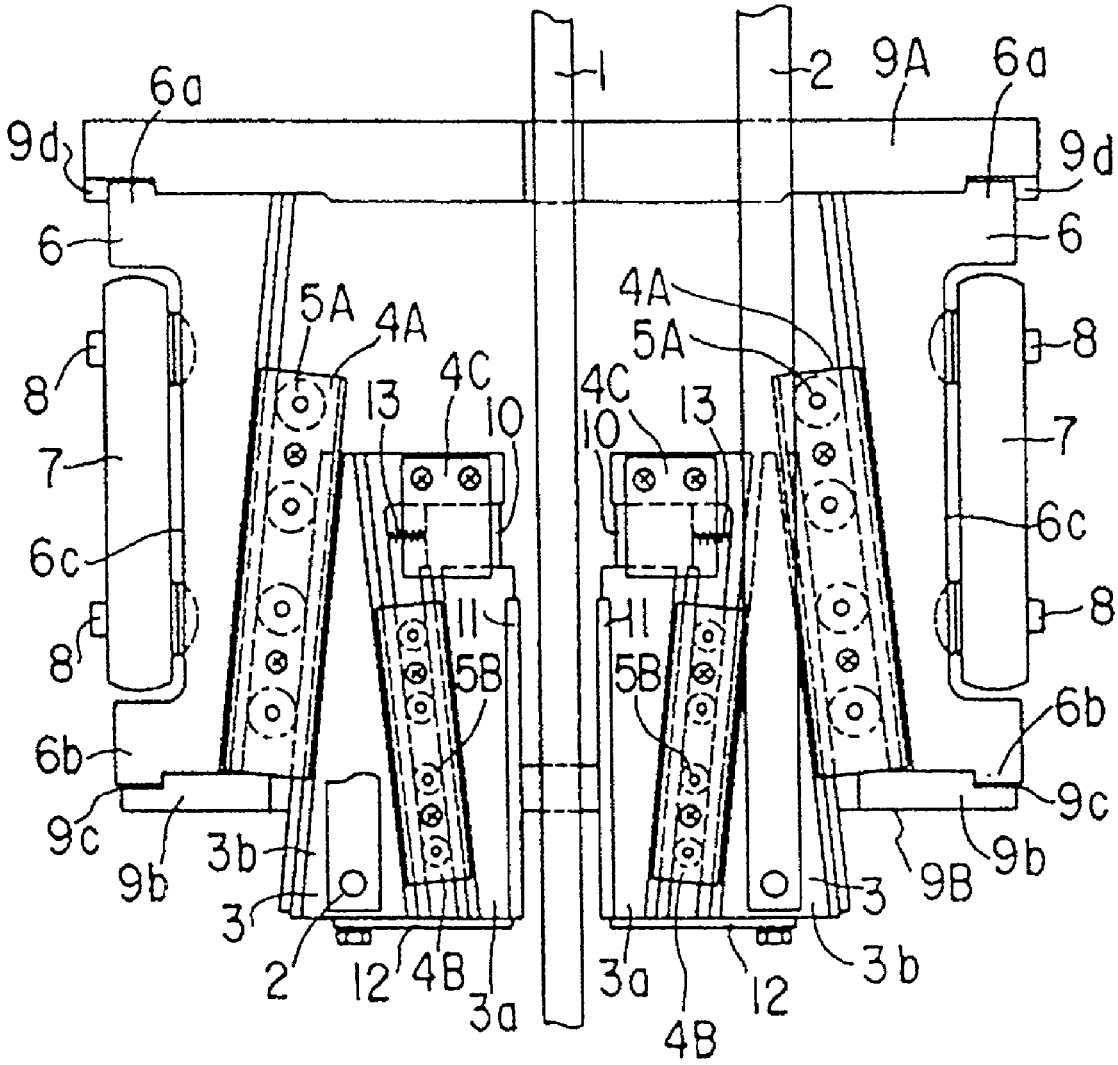
FIG. 1 is a plan view illustrating a first embodiment of an elevator emergency stop device according to the invention.
Figure 2A:
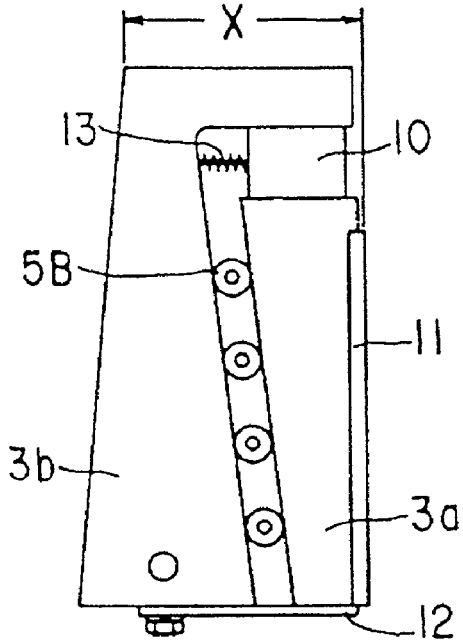
FIG. 2A is a diagram illustrating the construction of a wedge-shaped element of an elevator emergency stop device according to the invention in the case of a small braking force.
Figure 2B:
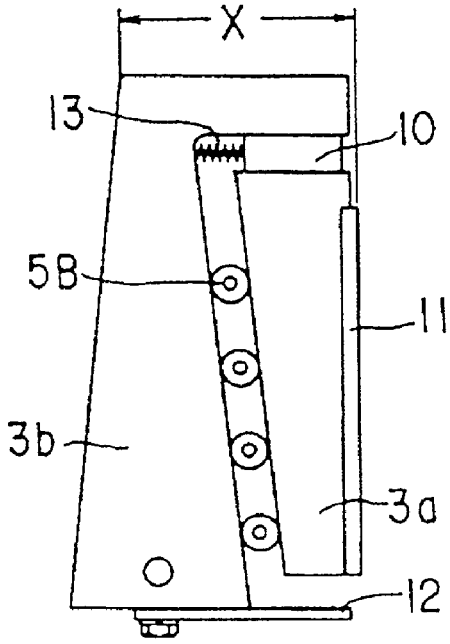
FIG. 2B is a diagram illustrating the construction of a wedge-shaped element of an elevator emergency stop device according to the invention in the case of a large braking force.
Figure 11:
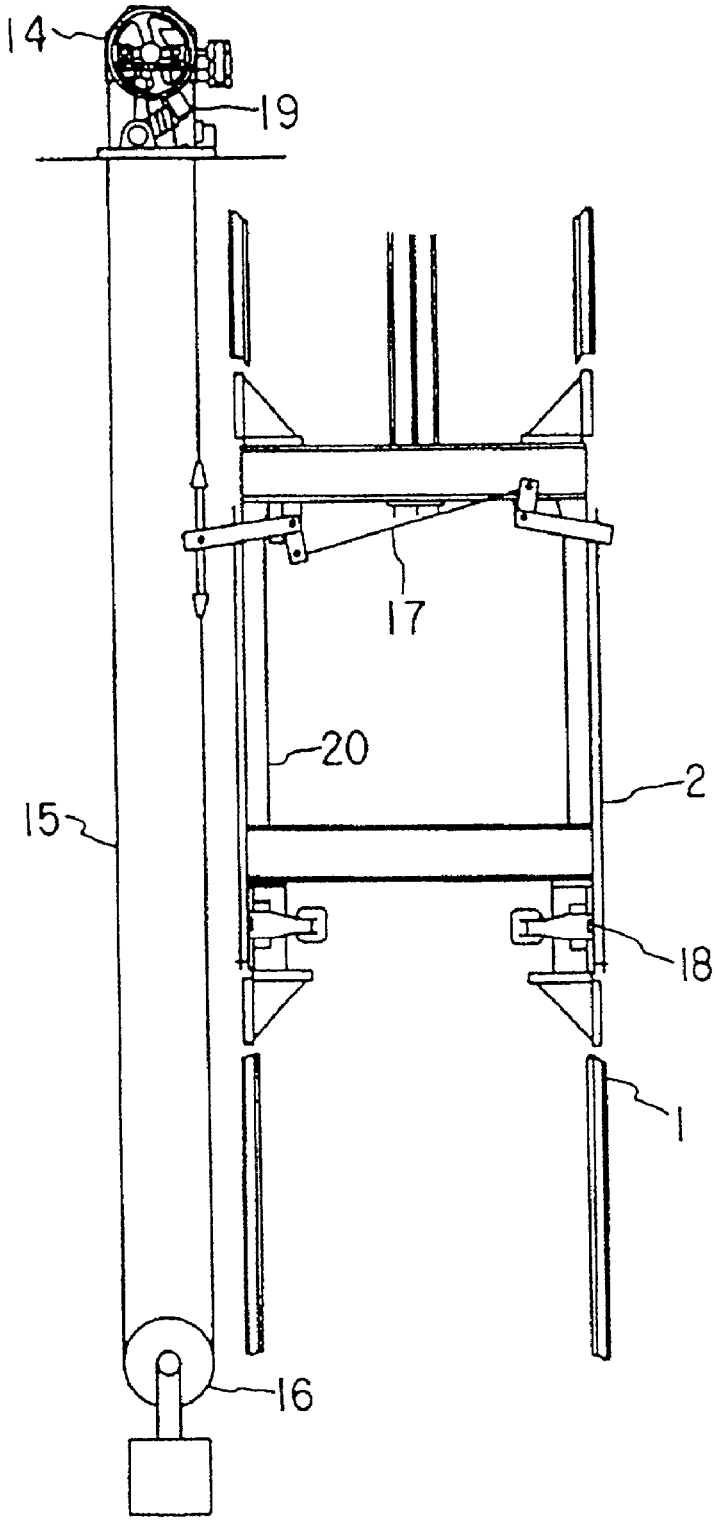
FIG. 11 is a cross-sectional diagram of the elevator ascent/descent path (what is sometimes called an elevator shaft or a hoistway), showing the installation environment of the elevator emergency stop device.
Figure 12:
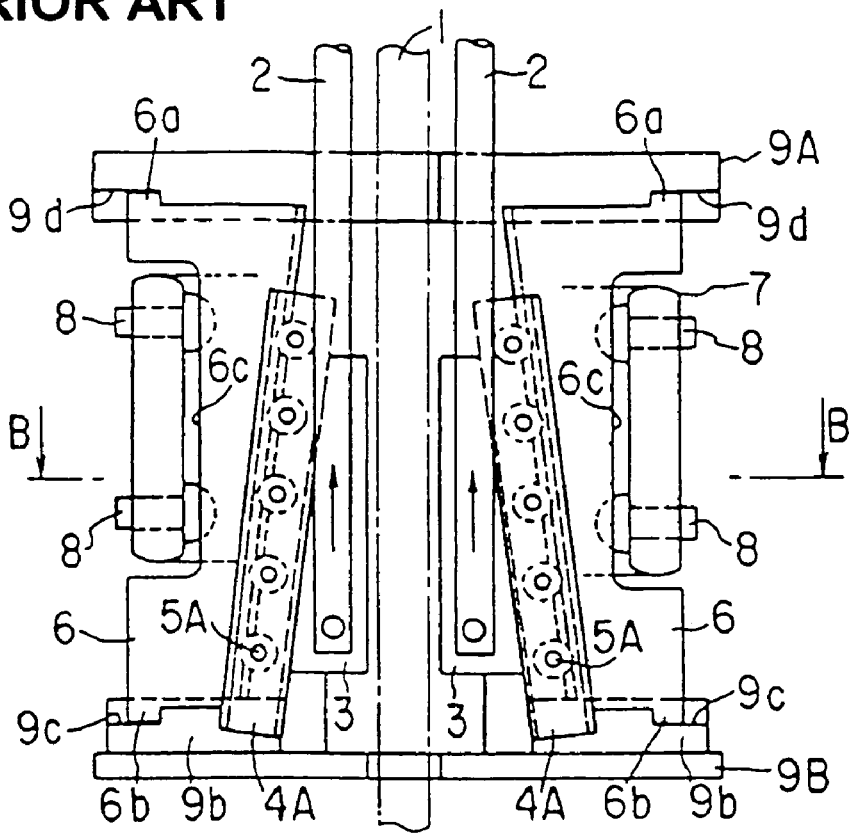
FIG. 12 PRIOR ART
FIG. 12 is a plan view illustrating an example of a prior art elevator emergency stop device.
Figure 13:
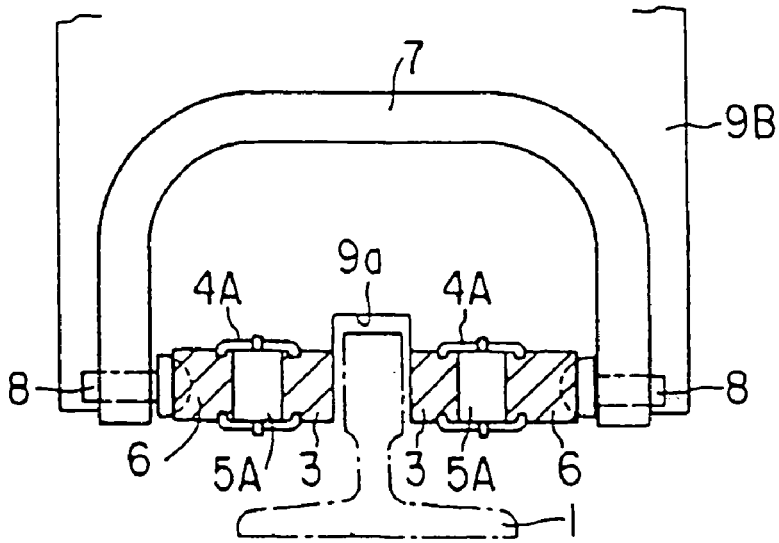
FIG. 13 PRIOR ART
FIG. 13 is a front view of FIG. 12.

FIG. 1 is a view illustrating a first embodiment of an elevator emergency stop device according to the invention, being a view corresponding to FIG. 11 in which prior art is illustrated. FIG. 2A illustrates diagrammatically the wedge-shaped element 3 of FIG. 1. FIG. 2A is a diagram of the case where the braking force is small and FIG. 2B is a diagram of the case where the braking force is large.

The difference in FIG. 1 and FIG. 2A from FIG. 11 which illustrates the prior art is that wedge-shaped element 3 is constituted divided into a moveable part 3*a* and a fixed part 3*b*.

Like the wedge-shaped element 3 of the conventional elevator emergency stop device shown in FIG. 11, the fixed part 3*b* has an outside inclined face section and rollers 5A are arranged at this outside inclined face section, being freely moveable upwards along the inclined faces of guide plates 6. The face of fixed part 3*b* that is opposite the outside inclined face section is formed with an inside inclined face section with inclination in the opposite direction to that of the outside inclined faces. As shown in FIG. 1, parallel guide grooves are formed in the inside inclined faces in the same way as in the outside inclined faces at the front and rear faces near the inside inclined face of fixed part 3*b*.

Moveable part 3*a* is of approximately trapezoid shape, with its upper end being wider; it has a sliding portion 11 on the face opposite guide rail 1, and its face opposite the fixed part 3*b* is formed with an inclined face parallel with the inside inclined face of fixed part 3*b*. Guide grooves parallel to the inclined face are formed on the front and rear faces of moveable part 3*a* in the same way as the guide grooves on the inside inclined face side of fixed part 3*b*.

Regarding the guide grooves of fixed part 3*b* and moveable part 3*a*, moveable part 3*a* is linked to fixed part 3*b* in such a way that it is free to be moved vertically by means of holding plates 4B and rollers 5B, with a construction identical with that of holding plates 4A and rollers 5A that link guide plates 6 and wedge-shaped elements 3.

As shown in FIG. 1, the top of moveable part 3*a* is connected with fixed part 3*b* through a resilient element 10 made of a metal element or the like; the arrangement is such that this can thereby move along the inside inclined face of fixed part 3*b* with deformation of resilient element 10 in the vertical direction.

Also, resilient element 10 is loosely fixed to fixed part 3*b* by means of a position-restraining element 13 comprising a coiled spring or the like, so as to maintain its position in the horizontal direction, being maintained by holding plate 4C such that it does not become detached from wedge-shaped element 3.

If the speed of descent of cage 20 exceeds the speed set by speed regulator (governor) 14, the rope-gripping unit 19 incorporated in speed regulator 14 is actuated to grip speed regulator rope 15.

Safety link 17 is thereby actuated, with the result that the pulling-up rods 2 of the descending cage 20 are pulled up relative to cage 20. Due to the relative rise with respect to cage 20 of the wedge-shaped elements 3 that are linked with the bottom ends of pulling-up rods 2, frictional force i.e. braking force is generated between sliding portion 11 of wedge-shaped elements 3 and guide rail 1.

Since the speed of sliding of sliding portion 11 and guide rail 1 immediately after commencement of braking is high, the coefficient of dynamic friction is small, so the braking force is small. The moveable parts 3*a* are therefore subjected to a comparatively small raising force from the sliding portions 11, so, since the flexure of resilient element 10 is also comparatively small, braking of moveable parts 3*a* is performed with an equilibrium in the vicinity of the intermediate part of the inside inclined faces of fixed part 3*b*.

When, as braking proceeds, the sliding speed of the sliding portions 11 and guide rail 1 becomes smaller, the coefficient of dynamic friction becomes larger, with the result that the braking force becomes large and the flexure of resilient element 10 becomes larger, so moveable parts 3*a* are raised relative to the fixed parts 3*b*.

Since moveable parts 3*a* rise along the inside inclined faces of fixed parts 3*b*, their positions in the horizontal direction approach fixed parts 3*b* (direction away from the guide rail) i.e. the width of the wedge-shaped element 3 as a whole (X dimension in FIG. 2A and FIG. 2B) becomes smaller. As a result, the flexure of spring 13 becomes smaller, causing the force with which sliding portion 11 of wedge-shaped element 3 is pressed on to guide rail 1 to become smaller.

Figure 3A:
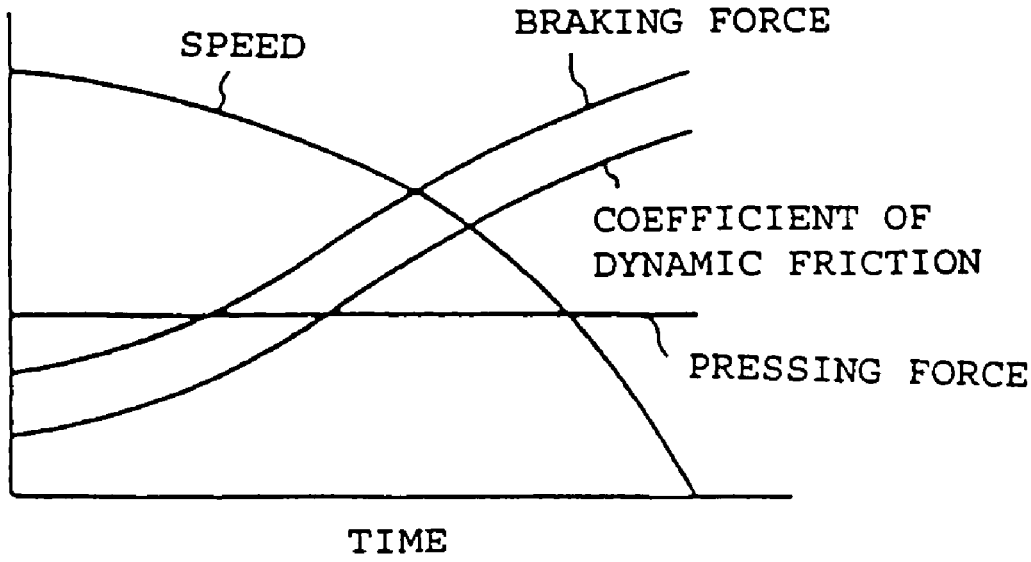
FIG. 3 A PRIOR ART
FIG. 3A is a view illustrating the braking characteristic of a conventional elevator emergency stop device.
Figure 3B:
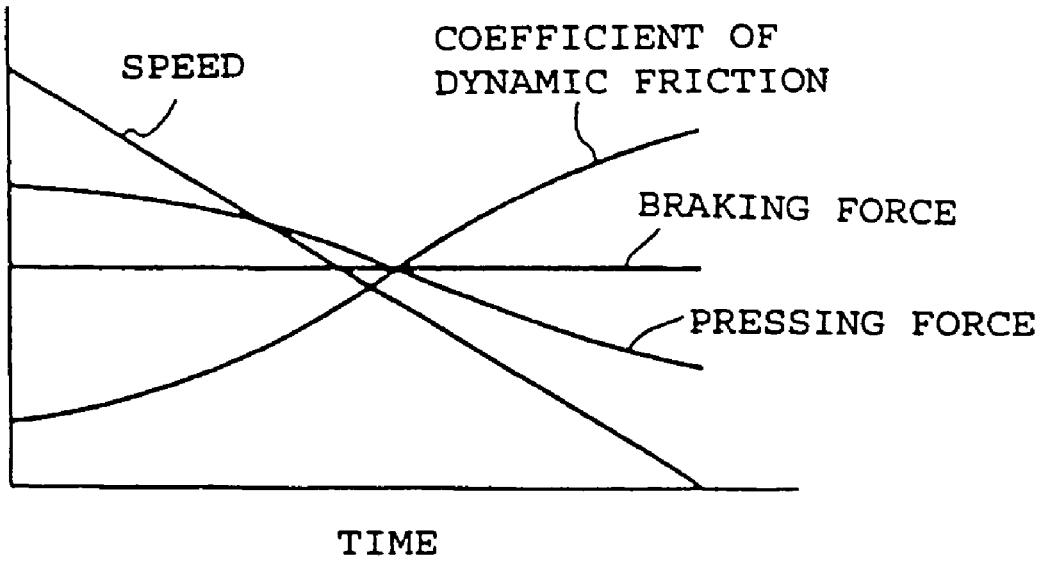
FIG. 3B is a view illustrating the braking characteristic of an elevator emergency stop device according to the invention.
Figure 4:
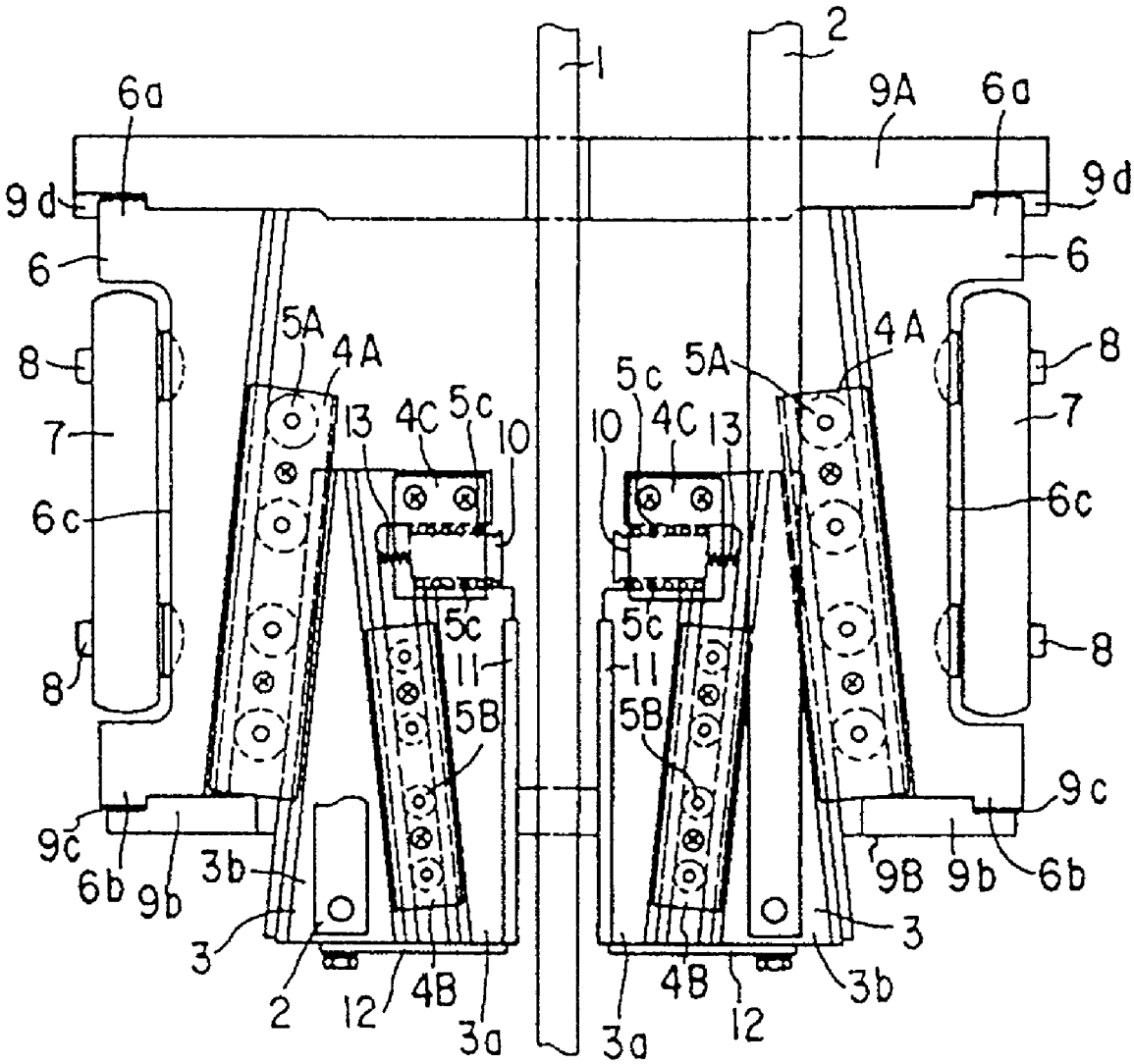
FIG. 4 is a plan view illustrating a second embodiment of an elevator emergency stop device according to the invention.
Figure 5:
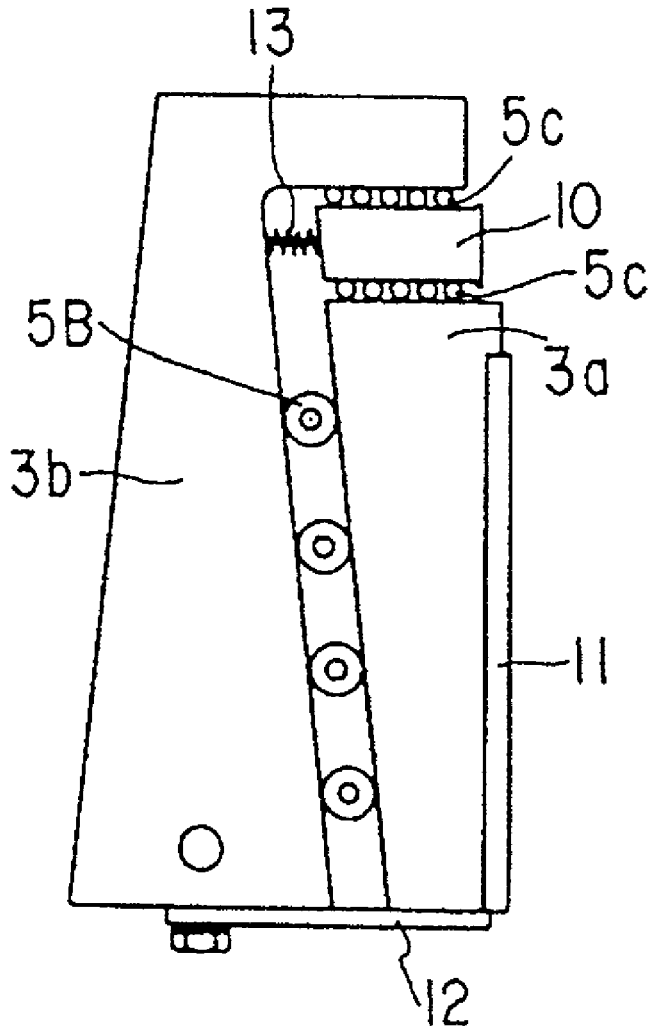
FIG. 5 is a diagram given in explanation of the construction of a wedge-shaped element according to the second embodiment of an elevator emergency stop device according to the invention.

Since the braking force (frictional force) is the product of the coefficient of dynamic friction and the pressing force, even though the coefficient of dynamic friction becomes large due to the sliding speed becoming small, the force with which the wedge-shaped elements 3 are pressed against the guide rail 1 is decreased, so, as shown in FIG. 3B, the braking force of the elevator emergency stop device is kept practically fixed, so emergency stopping of the cage can be achieved in a safe manner without any possibility of the braking force rising in the latter part of the emergency braking. FIG. 3A is a view showing the braking characteristic of a conventional elevator emergency stop device and FIG. 3B is a view showing the braking characteristic of an elevator emergency stop device according to the invention. Next, a second embodiment of the invention will be described with reference to FIG. 4 and FIG. 5. FIG. 4 and FIG. 5 respectively correspond to FIG. 1 and FIG. 2A of the first embodiment. The point of difference with respect to the first embodiment lies in the arrangement of rollers 5C constituting sliding elements above and below resilient element 10.

Typically, the braking force of an elevator emergency stop device is 500 kgf to a few tf per wedge-shaped element 3. This load is directly transmitted from moveable parts 3*a* through resilient element 10 to fixed parts 3*b*, so that frictional force between resilient element 10 and moveable parts 3*a* and fixed parts 3*b* rises to 50 kgf to a few hundred kgf.

It is therefore necessary that relative displacement of moveable parts 3*a* with respect to fixed parts 3*b* in order to effect fine adjustment of the width of wedge-shaped element 3 by moving moveable parts 3*a* so as to track changes in the coefficient of dynamic friction during braking should be conducted in a smooth fashion.

In the second embodiment of the invention, smooth movement of moveable parts 3*a* is achieved by arranging rollers 5C above and below resilient element 10 so as to sandwich resilient element 10, thereby making it possible to perform better fine adjustment of braking force. It should be noted that, instead of rollers, it would be possible to provide wheels, or to coat the sliding faces with silicone or Teflon (which is a trademark of a certain company);

furthermore, even in the case of the first embodiment, in which no rollers are provided, the benefits achieved are of course enormously greater than in the prior art practical example, in which no adjustment of braking force is performed.

Figure 6:
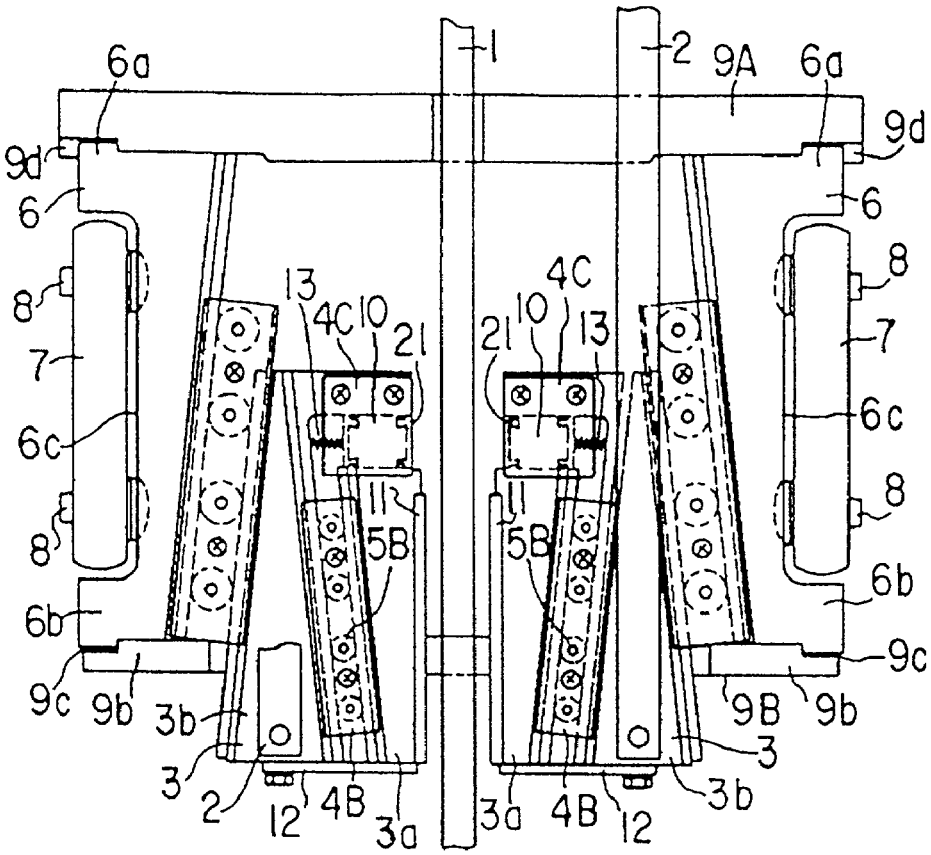
FIG. 6 is a plan view illustrating a third embodiment of an elevator emergency stop device according to the invention.
Figure 7:
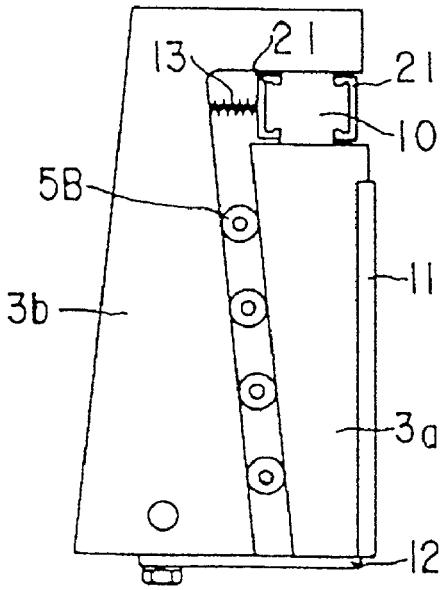
FIG. 7 is a diagram given in explanation of the construction of a wedge-shaped element of the third embodiment of an elevator emergency stop device according to the invention.

FIG. 6 and FIG. 7 illustrate a third embodiment of the invention. FIG. 6 and FIG. 7 respectively correspond to FIG. 1 and FIG. 2A of the first embodiment. The point of difference with respect to the first embodiment is that an initial pressure-regulating element 21 is mounted on resilient element 10 by shrinkage fitting or the like. The internal pressure of resilient element 10 is partially increased by an initial pressure regulating element 21, producing a load and flexure characteristic of resilient element 10 as shown by the polygonal line (1) of FIG. 8.

If the mean braking force of the elevator emergency stop device is assumed to be 1 tf per wedge-shaped element 3, the change of braking force produced by change in the coefficient of dynamic friction is roughly about 700 kgf to 1300 kgf. The displacement of moveable part 3*a* produced by this change in braking force is in the vicinity of the middle of the inside inclined face of fixed part 3*b* when the braking force is 700 kgf and is in the vicinity of the top of the inside inclined face of fixed part 3*b* when it is 1300 kgf. That is, only about half of the possible range of movement of moveable part 3*a* is employed for adjustment of braking force.

Accordingly, in the third embodiment of the invention, up to for example 700 kgf of the example described above, scarcely any flexure is produced by the initial pressure i.e. moveable part 3*a* stays in the vicinity of the bottom of the inside inclined face part of fixed part 3*b;* when the load exceeds 700 kgf, the amount of flexure for this load increases, causing the moveable part 3*a* to rise along the inside inclined face of fixed part 3*b,* moving to the vicinity of the uppermost part of the inside inclined face part when the load is 1300 kgf.

In this way, adjustment of braking force can be effected using practically the entire range of movement of moveable part 3*a,* thereby making it possible to provide a more stable braking characteristic.

Figure 9:
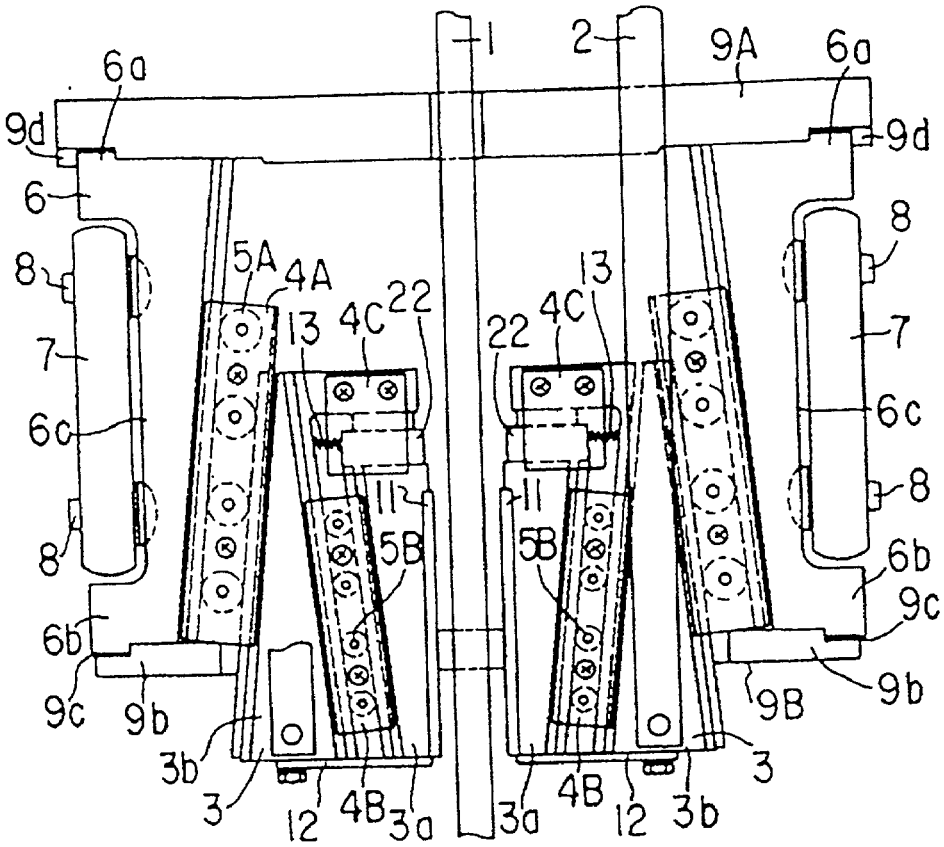
FIG. 9 is a plan view illustrating a fourth embodiment of an elevator emergency stop device according to the invention.
Figure 10:
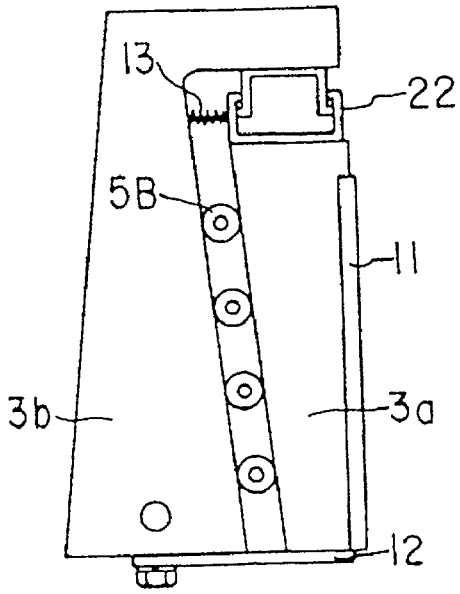
FIG. 10 is a diagram given in explanation of the construction of a wedge-shaped element of a fourth embodiment of an elevator emergency stop device according to the invention.

FIG. 9 and FIG. 10 illustrate a fourth embodiment of the invention. FIG. 9 and FIG. 10 respectively correspond to FIG. 6 and FIG. 7 of the third embodiment.

The respect in which this embodiment differs from the third embodiment is the provision of a piston 22 in which gas is sealed, instead of the resilient element 10 and initial pressure-regulating element 21.

Figure 8:
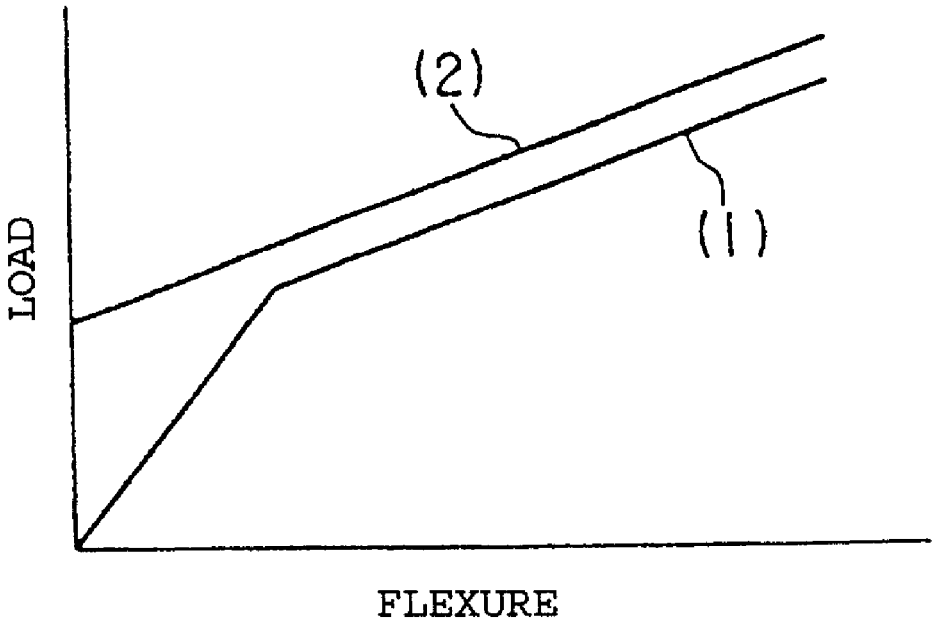
FIG. 8 is a graph showing the load and flexure characteristic of a resilient element of a third and fourth embodiment of an elevator emergency stop device according to the invention.

In the third embodiment, the initial pressure of the resilient element is applied by the initial pressure regulating element, so this initial pressure can only be applied partially, giving rise to a load and flexure characteristic that changes roughly in two steps as shown by the polygonal line (1) of FIG. 8.

In contrast, in the fourth embodiment, the load/flexure characteristic can be made to be as shown by the straight line (2) in FIG. 8, by employing a piston 22 in which high-pressure gas is sealed.

As a result, in the example described above, up to 700 kgf, the moveable part 3*a* is positioned at the lowest part of the fixed part 3*b,* thereby enabling the entire movement range of moveable part 3*a* to be made use of for adjustment of braking force, so making it possible to provide an even more stable braking characteristic.

POSSIBILITIES OF INDUSTRIAL APPLICATION

As described above, with the embodiment of the present invention, by adopting a construction in which the width of the wedge-shaped elements is changed in accordance with the braking force of the elevator emergency stop device, the force with which the wedge-shaped elements are pressed against the guide rail can be adjusted, so that an elevator emergency stop device can be provided wherein, even though the coefficient of friction changes, the braking force is held constant.

Also, according to the embodiment of the present invention, by adopting a construction of the wedge-shaped element comprising a fixed part having an outside inclined face part and a moveable part formed in wedge shape and having a sliding member whose upper part is engaged with the fixed part through a resilient element, being capable of moving along the inside inclined face of the fixed part, an elevator emergency stop device can be provided wherein the braking force is maintained constant by adjusting the width of the wedge-shaped element as a whole, by moving the moveable part along the inside inclined face of the fixed part in accordance with the braking force of the elevator emergency stop device.

Furthermore, also according to the embodiment of the present invention, by adopting a construction in which a moveable part and fixed part are engaged, with a resilient body being sandwiched by a pair of sliding elements, the moveable part moves more smoothly along the inside inclined face of the fixed part, thereby adjusting the width of the wedge-shaped element as a whole and making it possible to provide an elevator emergency stop device wherein the braking force is kept constant.

Furthermore, also according to the embodiment of the present invention, by adopting a construction in which the load/flexure characteristic of the resilient body is made such that the flexure is small or zero up to a certain load, but thereafter the load and flexure are in a practically proportional relationship, it is possible to employ the major part of the range of movement of the moveable part for adjustment of braking force, thereby enabling an elevator emergency stop device with more stable braking force to be provided.

Furthermore, also according to the embodiment of the present invention, by adopting a construction in which a piston in which gas providing an initial pressure is sealed is used as the resilient element, an elevator emergency stop device with even more stable braking force can be provided, as all of the range of movement of the moveable part can be employed for adjustment of braking force.

What is claimed is:

1. Elevator emergency stop device for an elevator cage guided on a guide rail, comprising:

a wedge-shaped element movable relative to the elevator cage to effect an emergency stop of said elevator cage by frictional force by means of a contact face of a sliding part thereof being pressed against said guide rail;

wherein said wedge-shaped element includes a first side and a second side, the first side including the contact face and the second side being a tapering side opposite the first side, wherein said wedge-shaped element comprises a fixed part and a movable part, the movable part including the contact face and being movable relative to the fixed part along an inclined face of the fixed part, such that a dimension of said wedge-shaped element in the direction perpendicular to said contact face is changed in accordance with braking force to maintain the braking force at a substantially constant level, and wherein said wedge-shaped element comprises a resilient element disposed between the fixed part and the movable part, the resilient element further comprising sliding elements disposed between the resilient element and the movable part and disposed between the resilient element and the fixed part.

2. Elevator emergency stop device according to claim 1, wherein said resilient element is configured to establish a relationship between a load and a flexure such that said flexure of said resilient element is small or zero up to a prescribed load, and flexure of said resilient element increases generally proportional to said load for loads above the prescribed load.

3. Elevator emergency stop device according to claim 2, wherein said resilient element comprises a piston in which is a pressured gas.

4. Elevator emergency stop device of claim 1, wherein the movable part is movable relative to the fixed part in an oblique direction relative to the guide rail.

5. Elevator emergency stop device for an elevator cage guided on a guide rail, comprising:

a wedge-shaped element that effects an emergency stop of said elevator cage by frictional force by means of a contact face of a sliding part thereof being pressed against said guide rail, wherein said wedge-shaped element comprises:

a mechanism whereby a dimension of said wedge-shaped element in the direction perpendicular to said contact face is changed in accordance with braking force to maintain the braking force at a substantially constant level, the mechanism comprising;

a fixed part having an outside inclined face part of said wedge-shaped element; and a wedge-shaped movable part having said sliding part;

said movable part being movable along an inside inclined face part of said fixed part and an upper part thereof being engaged with said fixed part by means of a resilient element.

6. Elevator emergency stop device according to claim 5, wherein in said wedge-shaped element said fixed part and said resilient element, and said resilient element and said movable part are engaged by means of respective sliding elements between said resilient element and said movable element and between said resilient element and said fixed element.

7. Elevator emergency stop device according to claim 5 or 6, wherein in said resilient element a relationship between a load and a flexure is such that said flexure is small or zero up to a prescribed load and above said prescribed load said relationship between said load and said flexure is a practically proportional relationship.

8. Elevator emergency stop device according to claim 7, wherein said resilient element comprises a piston in which is sealed gas that is given an initial pressure.

* * * * *